United States Patent [19]

Harper

[11] Patent Number: 4,461,396

[45] Date of Patent: Jul. 24, 1984

[54] COMBINED PLATES AND GLASS HOLDERS

[75] Inventor: James B. Harper, Warwick, England

[73] Assignee: Harford Overseas Limited, Gibralter

[21] Appl. No.: 450,159

[22] Filed: Dec. 15, 1982

[30] Foreign Application Priority Data

Oct. 7, 1982 [GB] United Kingdom ..... 8228757

[51] Int. Cl.[3] ..... A47G 19/03; A47G 19/06

[52] U.S. Cl. ..... 220/23.83; D7/38; 206/565; 220/23.8

[58] Field of Search ..... 220/1 R, 23.8, 23.83, 220/23.86; D7/38; 206/565

[56] References Cited

U.S. PATENT DOCUMENTS

| | | | |
|---|---|---|---|
| D. 251,102 | 2/1979 | Box | D7/38 |
| 421,264 | 2/1890 | Gibbons | 220/1 R |
| 2,107,023 | 2/1938 | Bertsch | 220/23.8 |
| 2,352,684 | 7/1944 | Braddock | 220/23.8 |
| 3,401,858 | 9/1968 | White | 220/23.86 |
| 3,779,369 | 12/1973 | Lang | 206/1.8 |
| 4,075,769 | 2/1968 | Young | 220/23.8 |

FOREIGN PATENT DOCUMENTS

| | | | |
|---|---|---|---|
| 2100326 | 8/1972 | Fed. Rep. of Germany . | |
| 3203150 | 12/1980 | Fed. Rep. of Germany . | |
| 1112590 | 3/1956 | France . | |
| 2297023 | 1/1977 | France . | |
| 137982 | 7/1930 | Switzerland . | |
| 2158 | of 1890 | United Kingdom | 220/23.83 |
| 255643 | 7/1926 | United Kingdom | 220/23.8 |
| 254533 | 7/1926 | United Kingdom . | |
| 1126304 | 9/1968 | United Kingdom . | |
| 2078493 | 6/1980 | United Kingdom | 220/23.83 |
| 2078095 | 1/1982 | United Kingdom . | |

*Primary Examiner*—George E. Lowrance

*Attorney, Agent, or Firm*—Sughrue, Mion, Zinn, Macpeak and Seas

[57] ABSTRACT

A combined plate and glass holder comprises support means presenting a first area for use as a plate, and a second area for use as a glass holder, the first and second areas being distinguishable by location-defining means, and the second area being located adjacent to an edge of the support means over which, in use, a thumb of a hand extends to press against a glass placed on the second area, with the fingers of the hand pressing against the support means from underneath.

6 Claims, 9 Drawing Figures

COMBINED PLATES AND GLASS HOLDERS

The present invention provides combined plates and glass holders and in so doing provides a practical answer to the difficulty most people meet in carrying a plate and a glass in one hand.

At many social functions, such as conference luncheons, wind-and-cheese parties and outdoor barbecues, it is necessary to carry a glass in the same hand as a plate, leaving the other hand free to take food from the plate. It can be awkward, however, to hold the plate and the glass level, particularly when the plate is full of food and the glass is full of drink.

An aim of the present invention has been to overcome this difficulty by utilising specially shaped support means which is to be carried in one hand and is to serve as both a plate and a holder for a glass.

The term "plate" is used herein to refer to any food retainer formed of any material and thus might alternatively be described as for example a shallow bowl, or a dish or a tray—the term "glass" is used herein to refer to any drink retainer formed of any material and thus might alternatively be described as for example a beaker, a wine glass or a mug.

In accordance with the present invention, a combined plate and glass holder comprises support means presenting a first area for use as a plate, and a second area for use as a glass holder, the first and second areas being distinguishable by location-defining means, and the second area being located adjacent to an edge of the support means over which, in use, a thumb of a hand extends to press against a glass placed on the second area, with the fingers of the hand pressing against the support means from underneath.

It will be appreciated that pressing the thumb and the fingers generally towards one another effectively clamps the glass and the plate together. It is envisaged that the fingers will normally underlie the first area, but if the user is a child or if the first area is uncomfortably hot, it may be that the fingers will underlie the second area. It is in any event desirable that the fingers press against a central region of the support means, thereby reducing the likelihood of the support means being tipped when a fork is used to remove food from the first area.

The combined plate and glass holder of the present invention is conveniently integrally formed of a conventional material. For example, it can be vacuum-formed or injection-moulded of a plastics material, or carved in wood, or cast in a ceramics material and fired. In other examples, it can be formed of stainless steel or stiff paper or cardboard by conventional manufacturing techniques. Decoration and/or glazing may be applied. Preferably, the overall shape is such that identical combined plates and glass holders interlock when stacked.

The first area may be fully or partly surrounded by an upstanding rim and may be sub-divided into two or more smaller compartments by one or more upstanding ribs. The ribs may help to separate different foods from one another and the rim may help to stop food falling off. The rim may also help in stacking and interlocking, particularly if it extends upwardly from around the entire periphery of the support means. The ribs may extend linearly, or in curves, and may be of uniform or different width along their length. The rim may give the support means a circular, oval, scalloped or other convenient outline.

The second area may be circular in plan and may be flat or shaped to co-operate with the base of a glass.

The location-defining means may be a pattern or just a line or other marking positioned at least partially ,round or within the periphery of the second area to indicate where a glass is to be placed. There may be, additionally or alternatively, similarly positioned structural location-defining means such as a continuous or discontinuous wall or one or more stops. If such structural location-defining means is arranged within rather than around the periphery of the second area, and extends upwardly rather than downwardly, it should still permit a glass to be placed thereupon. The base of a glass may have, for example, an annular groove or other recess formed therein to accommodate or even interengage with the location-defining means. If the second area is other than flat, its shape may at least help to distinguish it from the first area. The shape of the second area may thus itself act as the or part of the location-defining means.

The edge of the support means, over which the thumb is to extend, may define part of a hole through the support means, which has the advantage that the back of the thumb also acts to help steady the support means. Alternatively, said edge of the support means may define part of a slot-like indentation in the support means, or just define part of the periphery of the support means. It is envisaged that the layout may be such as to facilitate carrying in just the left hand, or just the right hand, or in either of the left and right hands.

The thumb may be protected, in use, from food spilling over from the first area, by guard means—such as walls or ribs—which may be located generally laterally of the edge of the support means, over which the thumb is to extend.

The combined plate and glass holder of the present invention may be intended to be disposable or intended to be durable.

In a particularly preferred embodiment, the location-defining means extends upwardly from the periphery of the second area to provide lateral support by forming a shallow circular recess whose diameter approximates to that of the base of a glass.

In said particularly preferred embodiment, the base of a non-stemmed glass (such as a beaker) can be pressed against the location-defining means by a thumb, whereas in all embodiments the base of a stemmed glass (such as a wine glass) can be pressed against the second area by a thumb.

Several embodiments of the present invention will now be described by way of example only with reference to the accompanying drawings wherein.

Figure 1:
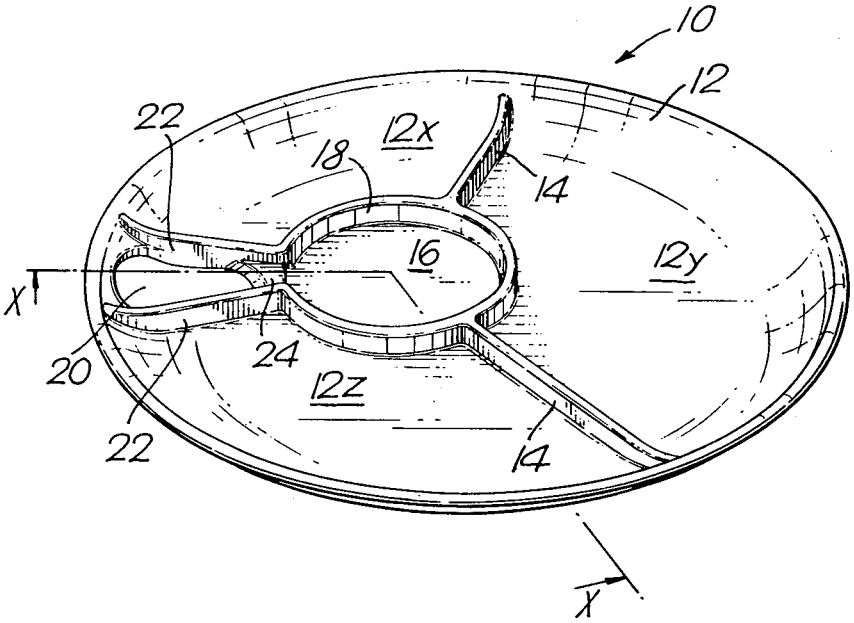
FIG. 1 is a perspective view from above of a first embodiment of the present invention.
Figure 2:
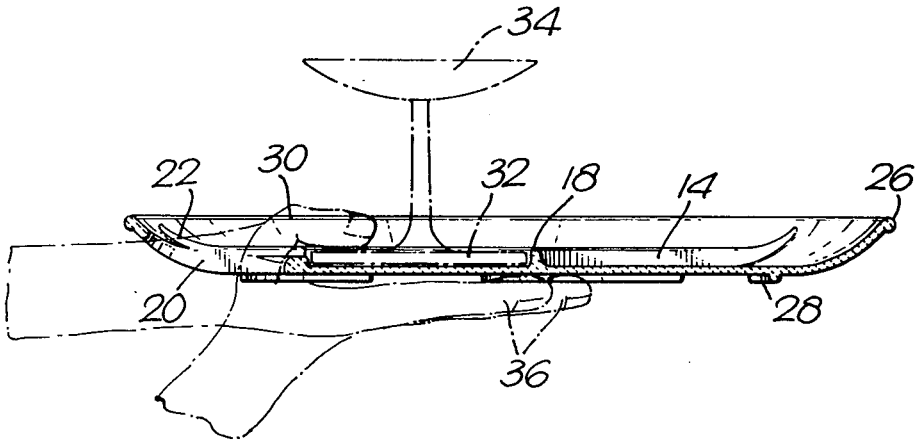
FIG. 2 is a cross-section taken along the broken line X—X of FIG. 1.
Figure 3:
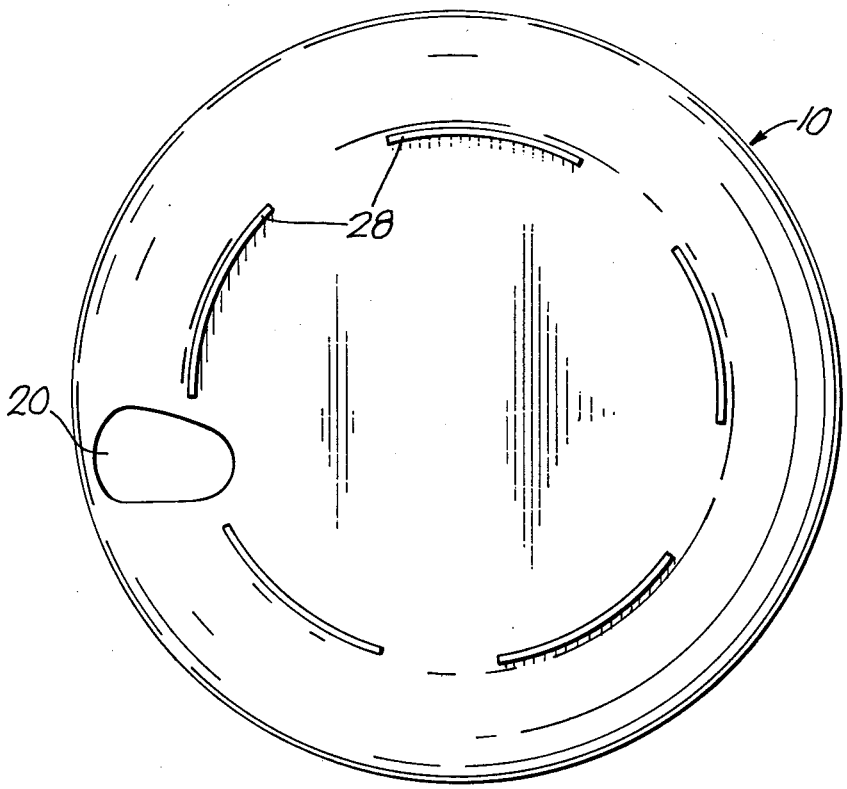
FIG. 3 is an underneath view of FIG. 1.
Figure 4:
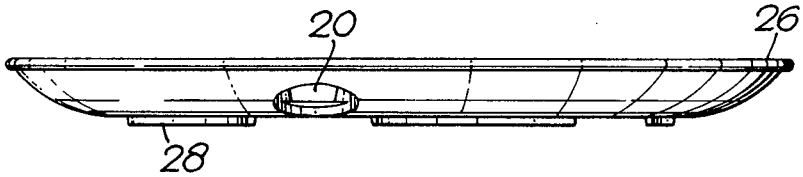
FIG. 4 is a side view taken from the left-hand side of FIG. 1.

Referring initially to FIGS. 1 to 4 a first embodiment of a combined plate and glass holder in accordance with the present invention is shown in full line with a wine glass and part of a user's hand being shown in dotted line in FIG. 2.

Support means 10 is formed in one-piece of a ceramics material and presents three compartments 12*x*, 12*y*, 12*z* separated by upstanding ribs 14, a shallow circular recess 16 surrounded along the major part of its periphery by an upstanding continuous wall 18, and a thumb hole 20 separated from the adjacent compartments 12*x*, 12*z* by upstanding ribs 22 and from the adjacent recess 16 by an upstanding wall 24.

The support means 10 is also shown with a circular rim 26 and arcuate stands 28.

Clearly, the compartments 12*x*, 12*y*, 12*z* together form a plate 12 constituting the first area, with the recess 16 in which a glass 34 is to be held consituting the second area, the wall 18 constituting the location-defining means, and the wall 24 constituting the edge of the support means 10 over which a thumb is to extend.

THe manner of intended use of the support means 10 is indicated in FIG. 2 where thumb 30 is shown pressing down on the base 32 of the glass 34, and fingers 36 are shown pressing up underneath the compartments 12*x*, 12*y*, 12*z* between the arcuate stands 28.

Further embodiments of combined plates and glass holders in accordance with the present invention are shown in FIGS. 5 to 9 in which similar components to those of FIGS. 1 to 4 have been given the same reference numbers with appropriate suffixes.

Figure 5:
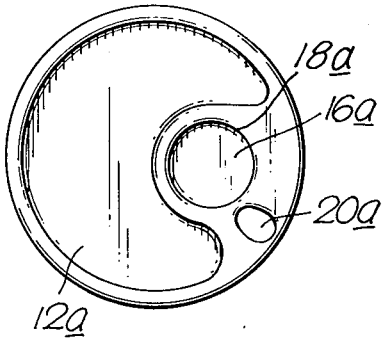
FIGS. 5 and 9 are plan views from above of further embodiments of the present invention.
Figure 6:
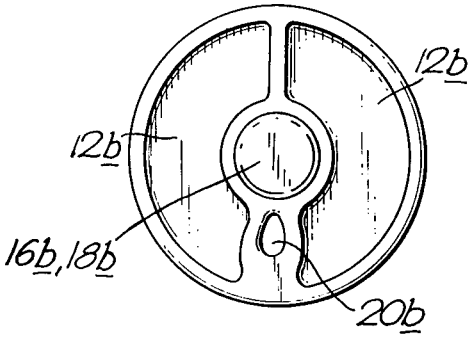
Figure 7:
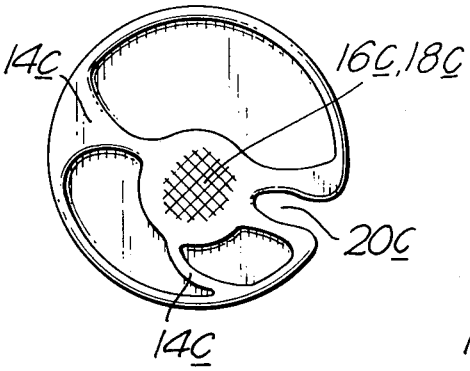
Figure 8:
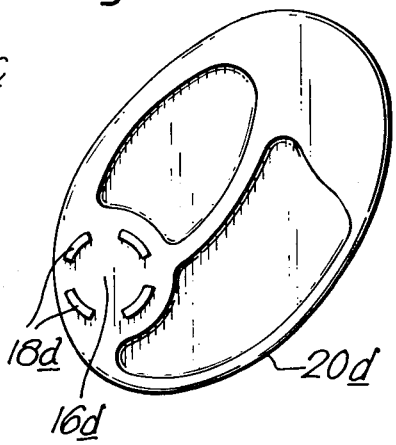
Figure 9:
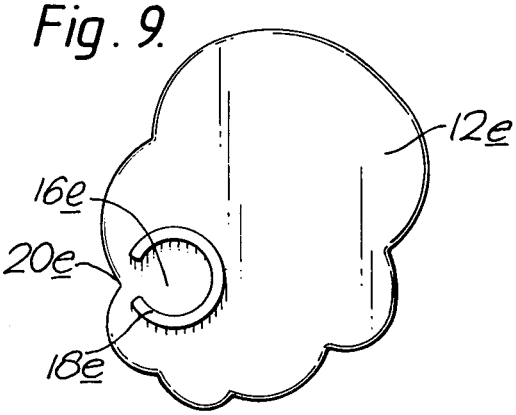

Attention is directed particularly to the following features: in FIG. 5, a flat upper surface is recessed at 12*a* to form the first area and at 16*a* to form the second area, the second area 16*a* thus being surrounded by an upstanding wall 18*a;* in FIG. 6, suitable for use by either a left-handed or a right-handed person, the second area 16*b* is formed as an upwardly extending dome 18*b;* in FIG. 7, there is a thumb slot 20*c* and the location of the second area 16*c* is defined by a hatched pattern 18*c;* in FIG. 8, an oval platter is formed with neither a thumb hole nor its periphery 20*d* with a thumb slot, and the location-defining means is constituted by a plurality of stops 18*d* arranged around the periphery of the second area 16*d;* and in FIG. 9, a scalloped shallow bowl presents a thumb slot 20*e*, with the location-defining means being a discontinuous wall 18*e* arranged within the periphery of the second area 16*e*, for location within a recess in the base of a glass.

I claim:

1. A combined plate and glass holder comprising integrally formed support means including a planar portion having a peripheral margin surrounding a first area for use as a plate and a second area at least partially surrounded by said first area for use as a glass holder, the first and second areas being defined by location-defining means which is at least partially in the form of structure extending upwardly from said planar portion about at least part of the periphery of the second area to provide lateral support for a glass positioned on said second area, a single hole through the support means inwardly of the peripheral margin with one opposed edge of the hole being located adjacent to the peripheral margin and the other edge adjacent the second area; whereby, in use, a thumb of a hand extends over said edge of the hole to press against a glass placed on the second area, with the back of the thumb pressing against said opposed edge of the hole to provide stability and all of the fingers of the hand pressing against the first area from underneath to provide further stability.

2. A combined plate and glass holder according to claim 1, in which planar support means is formed of sheet material.

3. A combined plate and glass holder according to claim 2, in which the support means is formed of stiff paper, making the combined plate and glass holder disposable.

4. A combined plate and glass holder according to claim 2, in which the support means is formed of a plastics material, making the plate and glass holder disposable.

5. A combined plate and glass holder according to claim 1, further comprising guard means in the form of upstanding ribs along both sides of the hole, radially inwardly of the margin for protection of the thumb against any food spilling over from the first area into the area of the hole.

6. A combined plate and glass holder according to claim 1, wherein said second area location defining means comprises an upwardly projecting ring and said ring includes an opening aligned with said single hole at said other edge, thereby facilitating projection of said thumb into said second area for pressing against said glass.

* * * * *